US007104815B2

(12) United States Patent
Ng et al.

(10) Patent No.: US 7,104,815 B2
(45) Date of Patent: Sep. 12, 2006

(54) RECEPTACLE FOR BOOSTER CABLE WITH CLAMP

(75) Inventors: Wing Hok Ng, 23/F No. 1 Des Voeux Raod West, Hong Kong (HK); Chi Choeng Lo, Shenzhen (CN)

(73) Assignee: Wing Hok Ng, Hong Kong (HK)

( * ) Notice: Subject to any disclaimer, the term of this patent is extended or adjusted under 35 U.S.C. 154(b) by 0 days.

(21) Appl. No.: 10/829,470

(22) Filed: Apr. 22, 2004

(65) Prior Publication Data

US 2005/0095907 A1 May 5, 2005

(30) Foreign Application Priority Data

Apr. 29, 2003 (CN) ..... 03 2 25587

(51) Int. Cl.
*H01R 13/44* (2006.01)

(52) U.S. Cl. ..... 439/135; 439/521; 439/822

(58) Field of Classification Search ..... 439/135, 439/521, 892, 148, 754, 759, 366, 367, 371, 439/822, 503–505; 320/105; 362/184; 307/150
See application file for complete search history.

(56) References Cited

U.S. PATENT DOCUMENTS 2,266,130 A * 12/1941 Theriault ..... 439/268
2,375,656 A * 5/1945 Jackson ..... 439/732
4,736,480 A 4/1988 Bohl et al.
5,026,307 A * 6/1991 Lee ..... 439/755
5,166,478 A * 11/1992 Sprouse ..... 174/138 F
5,183,407 A * 2/1993 Srol ..... 439/135
6,756,764 B1 * 6/2004 Smith et al. ..... 320/105
6,799,993 B1 * 10/2004 Krieger et al. ..... 439/500

FOREIGN PATENT DOCUMENTS

| | | |
|---|---|---|
| CN | 2224702 | 4/1996 |
| EP | 0141579 | 5/1985 |
| EP | 1045499 | 10/2000 |

* cited by examiner

*Primary Examiner*—Tho D. Ta
*Assistant Examiner*—James R. Harvey
(74) *Attorney, Agent, or Firm*—Rabin & Berdo, P.C.

(57) ABSTRACT

A receptacle for vehicle booster cable with a clamp has a body for receiving a clamp. The body has an open entrance end and a closed stopping end. A pair of protrusions is radially and inwardly protruded from the opposite sides of the open entrance end. Their shape matches with the recesses provided on the outer side surface of handgrip portion of the clamp so as to maintain the clamp in the body in a snap fasten manner when the clamp is inserted into the receptacle while the clamp is not in use.

6 Claims, 4 Drawing Sheets

RECEPTACLE FOR BOOSTER CABLE WITH CLAMP

BACKGROUND OF THE INVENTION

1. Field of the Invention

The present invention relates to means for preventing access to live contacts, and particularly to a receptacle for a vehicle booster cable with clamp.

2. Description of the Related Art

Generally speaking, a vehicle booster cable clamp with spring actuated metallic clamping jaws is enclosed by a sheath made of insulative material such as plastic. The clamp is fixed on one end of the booster cable, the collet of which clips on the terminal of a car battery. The other end of the booster cable is coupled to a power source such as a spare battery case of the vehicle. If one end of the booster cable connects with the power supply while the other end is allowed to lay loosely about, there is a potential hazard. Moreover, there is also need for a safe, fast and reliable receptacle for the clamps and cable while not in use.

In order to fulfill the needs mentioned above, U.S. Pat. No. 5,166,478 to Kerry Sprouse discloses an insulative protective sheath for the live end of a vehicle booster cable, wherein the sheath comprises a receptacle with interior and exterior portions constructed of insulative material, and includes a permanent closed stopping end and a open entrance end. In the receptacle, a vertical retainer mounting plate is provided at the closed stopping end. The open entrance end is accessible for insertion of a clamp into the interior portion. After inserting thereinto, the collet is kept in the receptacle by means of the clamp to clip the retainer mounting plate, while another clamp connects the outer fixation component via the exterior of the sheath. Such a retained clamp can be easily loosed from the receptacle under vibration or outside force and forms a short circuit by contacting another externally placed clamp. U.S. Pat. No. 5,183,407 to Karl Srol discloses another safety cap of a vehicle booster cable. However, such a safety cap is similar to Sprouse's protective receptacle. So Srol's safety cap also have aforesaid deficiencies.

The present invention provides a novel receptacle for booster cable with clamp, which is safe and portable.

SUMMARY OF THE INVENTION

Accordingly, it is an object of present invention to provide a receptacle for vehicle booster cable with a clamp, which comprises a body for receiving the clamp, while the body has an open entrance end and a closed stopping end opposite to the open entrance end, the interior shape of which matches with the exterior shape of the clamp sheath, wherein a radially and inwardly protruded protrusion is provided on opposite sides of the upper portion of the open entrance end respectively, and said protrusions match with recesses formed on the outer side surface of handgrip portion of the clamp.

The shape of the recesses of the outer side surface of the handgrip portion of the clamp substantially matches with the impression of finger.

At least one side of other opposite sides of the upper portion of the open entrance end of the receptacle provides a recess portion, which matches with the shape of at least one of the protrusions of the pivot of the cable clamp.

Alternately, other opposite sides of the upper portion of the open entrance end of the receptacle provide recess portions respectively, which match with the shape of two protrusions of the pivot of the cable clamp.

The recess portion is substantially "U" shape with the protrusions of the pivot of the cable clamp appearing as a disc shape.

The body and the handgrip portion of the clamp are formed of plastic material.

BRIEF DESCRIPTION OF THE DRAWINGS

The invention will be described in further detail below with reference to the annexed drawings, in which.

DETAILED DESCRIPTION OF THE INVENTION

Figure 1:
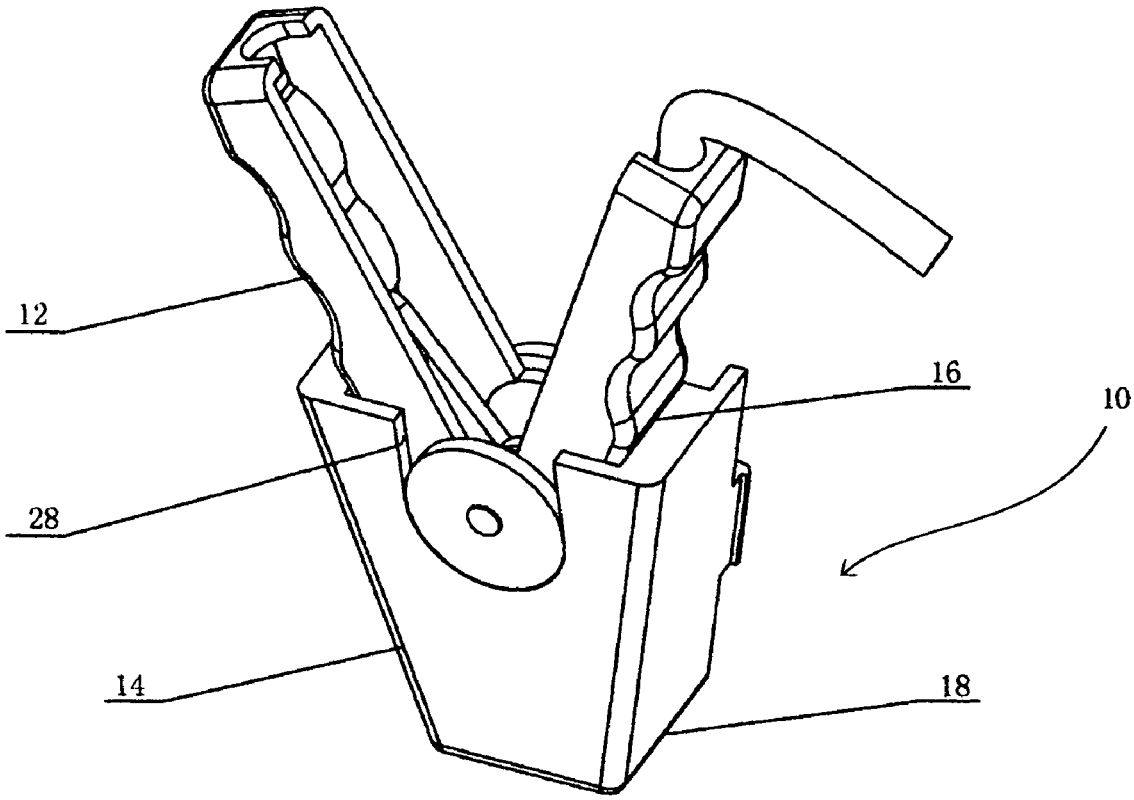
FIG. 1 is a perspective view of the present invention.
Figure 2:
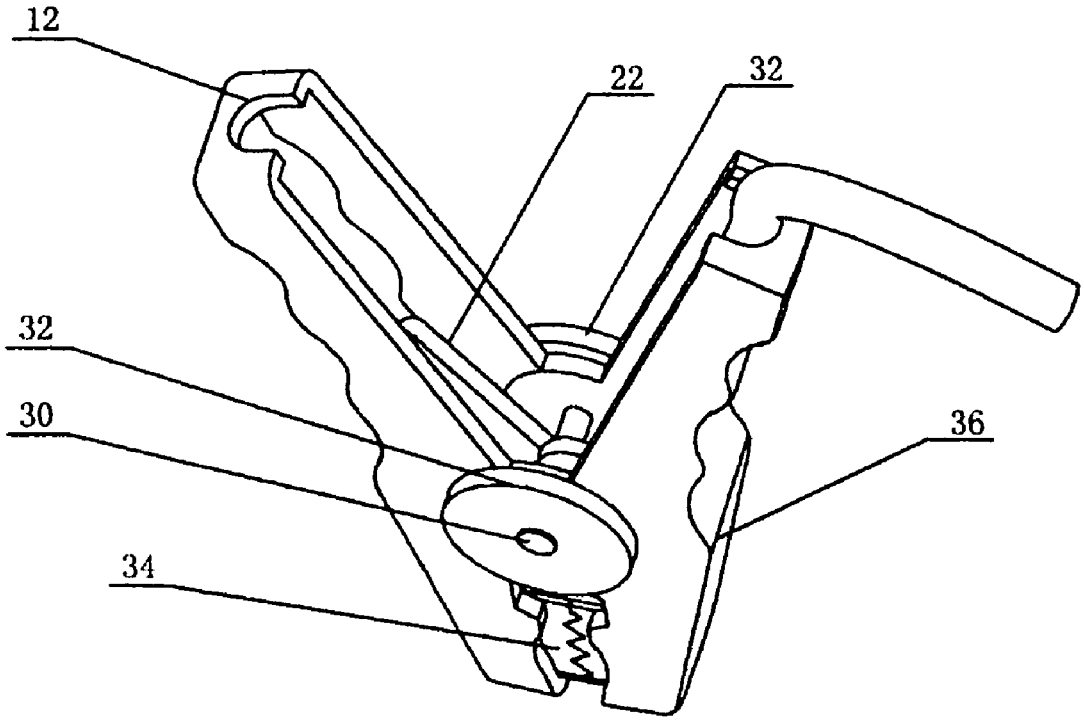
FIG. 2 is a perspective view of cable clamp of FIG. 1.
Figure 3:
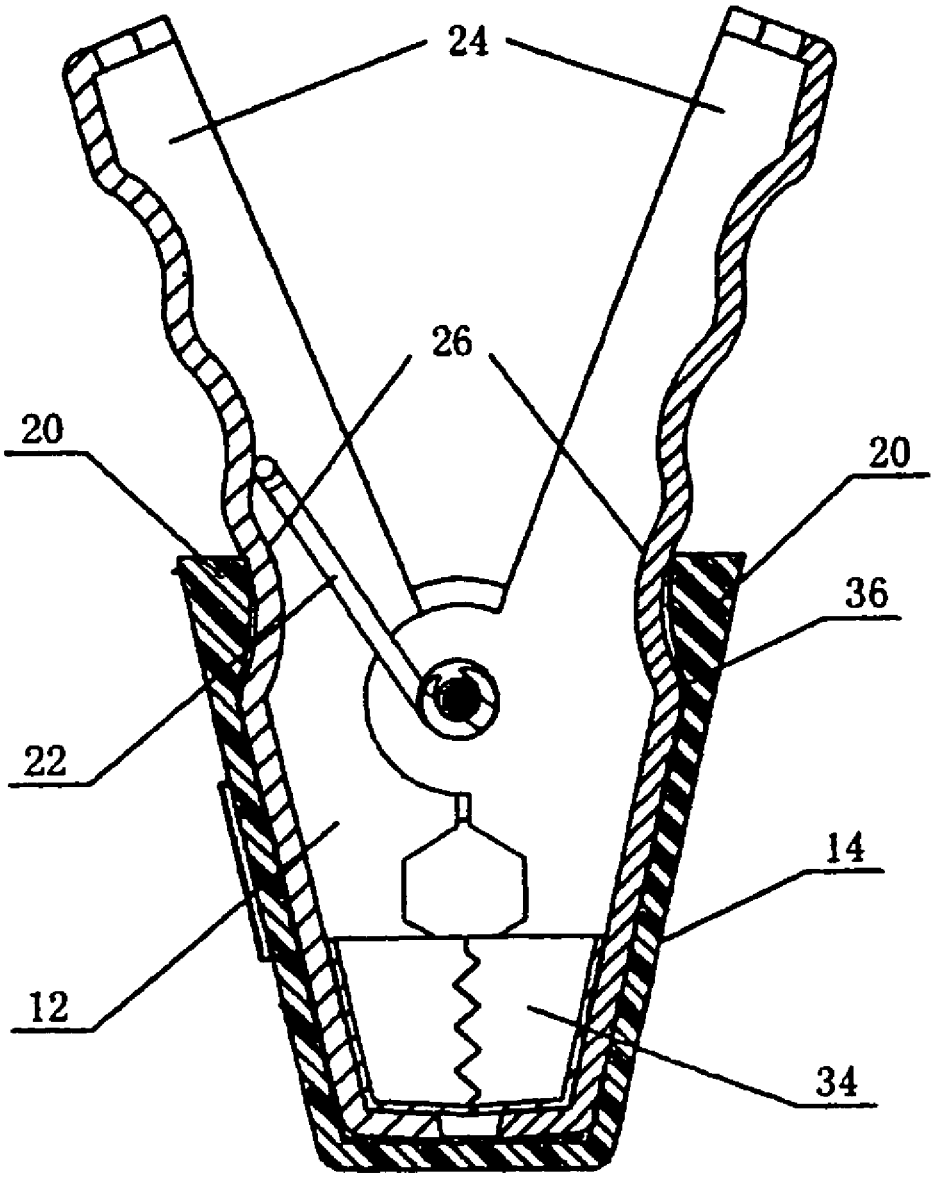
FIG. 3 is a front sectional view of present invention of FIG. 1.
Figure 4:
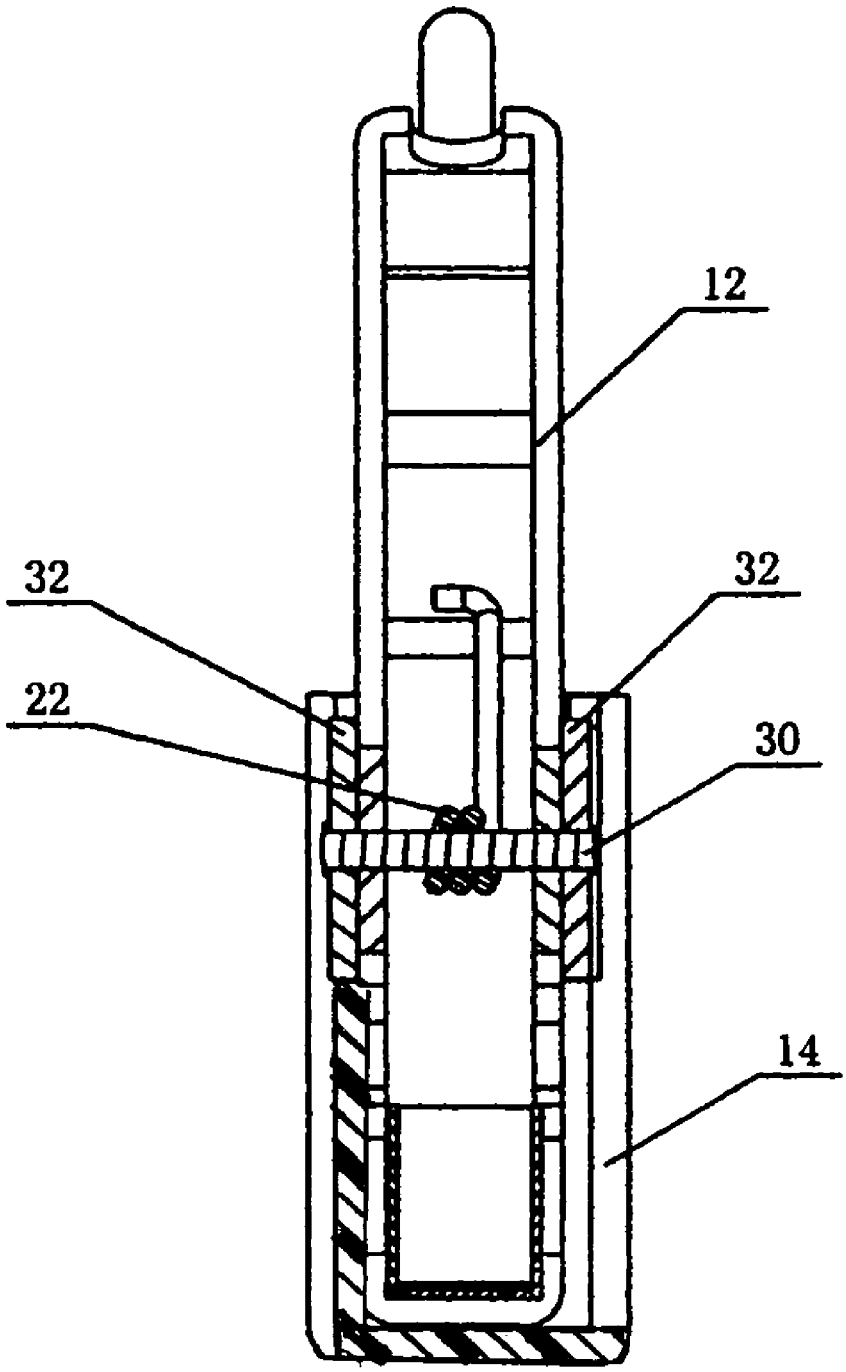
FIG. 4 is a side sectional view of present invention of FIG. 1.

As shown in FIG. 1 to FIG. 4, a receptacle 10 for a vehicle booster cable clamp according to the present invention includes a concave body 14 constructed of insulative material for receiving a vehicle booster cable clamp 12, and having a open entrance end 16 for insertion of the clamp and a closed stopping end 18.

The body 14 is substantially in a trapezoidal shape, which tapers from the open entrance end to the closed stopping end, the interior shape of which matches with the exterior shape of the clamp sheath. A radially and inwardly protruded protrusion 20 is provided on opposite sides of the upper portion of the open entrance end 16, and the outer side surface of the protrusion 20 is preferably in an arc shape.

Generally, the collet 34 of the clamp 12 of the booster cable terminal is an alligator clamp, the fixed end of which is enclosed within a sheath being integrally formed with the clamp handgrip portion 24, and the collet 34 is closed by means of a bias spring 22 provided on the pivot axis 30 of the handgrip.

In this embodiment, the clamp 12 is designed in such a shape that: the outer side surface of the clamp's handgrip portion 24 has a recessed configuration which substantially conforms to finger's impression and both handgrips are preferably symmetric with each other; when the collet portion 34 of the clamp 12 is entirely inserted into the body 14, the protrusions 20 of opposite sides of the open entrance end 16 of the body 14 just cooperate with recesses 26 of the handgrip portion 24 of the clamp, while the end point (starting point) of the lower end of said recess is just sustained at the bottom of protrusions 20. Such a type of design results in that, on one hand, the clamp is easily kept in the body, and on the other hand, the handgrip of the clamp is easily hand-held.

In order for the clamp firmly to be retained in the body without loosening, the recess portions 28 may be provided on opposite sides of the open entrance end 16 of the body 14, respectively. In this embodiment, the recess portions 28 appear as a "U" shape. Both ends of the axis 30 of the clamp provide a protruded component 32 respectively, such as for example but not limited to, a disc component. Both protruded components 32 are respectively on both sides of the handgrip portions. Each of the protruded components 32 is tightly fit with the corresponding one recess portion 28; thereby, after the collet 34 of the clamp 12 is entirely inserted into the body 14, the protruded portions 32 are just locked into the corresponding recess portions 28, so as to make the clamp 12 further be fixed in the body 14. Of course, the recess portions and the protruded portions can also use other shapes for tight fitting with each other.

In another embodiment, a recess portion can also be provided on only one side of the open entrance end 16 of the body, while the corresponding end of the axis of the clamp provides a protruded portion that is tightly fitted with the recess portion.

In the aforesaid embodiments, the sheath of the clamp and the handgrip portion and the body are made of insulative material.

Due to this type of design having the protrusions 20 provided at the open entrance end of the body and the shape of the clamp being tightly fitted with the body, the clamp and the body can work as a snap fastener. The, when one of the clamps of the booster cable is inserting into or pulling out of the body, a gentle sound of "click" can be heard.

Generally speaking, both clamps of the booster cable match with each body respectively, while the body can be secured with associated devices such as a spare battery charger on the same side or on opposite sides. General methods can be used for securing the body, such as snap hanging, affixation and so on.

Preferred embodiments of the present invention have been described with reference to the annexed drawings and using specific terms, but these are only for general description, and not limitation. It should be understood, however, that various modifications would be apparent to those skilled in the art, without departing from the scope of the invention as defined in the appended claims. Hence, it should be recognized that such some variations or modifications come within the scope of the invention.

We claim:

1. A receptacle for a vehicle booster cable with clamp, which comprises a concave body with only one open entrance end for inserting the clamp into the body and a closed stopping end opposite to the open entrance end, the interior shape of which matches with the exterior shape of a clamp sheath, wherein a radially and inwardly protruded protrusion is provided on opposite sides of the upper portion of said open entrance end respectively, and said protrusions match with the recesses formed on the outer side surface of a handgrip portion of the clamp; and wherein at least one of two other opposite sides of the upper open entrance end of the body comprises a recess portion;

wherein the two other opposite sides of the upper open entrance end of the body each comprises a respective recess portion which matches with a respective protruded component of either side of the clamp pivot.

2. The receptacle of claim 1, wherein a recess shape of the outer side surface of the handgrip portion of the cable clamp substantially comprises the shape of a finger's impression.

3. The receptacle of claim 1, wherein the recess portion matches with the shape of at least one protruded component of a clamp pivot of the clamp.

4. The receptacle of claim 3, wherein the recess portion is substantially in a "U" form, while the protruded portion of the clamp pivot is in a disc form.

5. The receptacle of claim 1, wherein said body and the handgrip of the clamp are made of plastic material.

6. The receptacle of claim 1, wherein the recess portion is substantially in a "U" form, while the protruded portion of the clamp pivot is in a disc form, and wherein the clamp includes a protruded component that substantially surrounds a pivot axis of the clamp and is nested in the "U" formed recess on the body, and the "U" formed recess includes an opening adjacent to the open entrance on the body.

* * * * *